US012305389B2

(12) United States Patent
Weller

(10) Patent No.: US 12,305,389 B2
(45) Date of Patent: May 20, 2025

(54) FLOOR PANEL AND METHODS OF USE THEREOF

(71) Applicant: Warren Weller, Cooroy (AU)

(72) Inventor: Warren Weller, Cooroy (AU)

( * ) Notice: Subject to any disclaimer, the term of this patent is extended or adjusted under 35 U.S.C. 154(b) by 290 days.

(21) Appl. No.: 17/920,846

(22) PCT Filed: Apr. 23, 2021

(86) PCT No.: PCT/AU2021/050362

§ 371 (c)(1),
(2) Date: Oct. 24, 2022

(87) PCT Pub. No.: WO2021/212177

PCT Pub. Date: Oct. 28, 2021

(65) Prior Publication Data

US 2023/0131686 A1 Apr. 27, 2023

(30) Foreign Application Priority Data

Apr. 23, 2020 (AU) ..... 2020901274

(51) Int. Cl.
*E04F 15/02* (2006.01)
*A47K 3/40* (2006.01)
*E04B 5/02* (2006.01)

(52) U.S. Cl.
CPC ..... *E04B 5/026* (2013.01); *A47K 3/40* (2013.01); *E04F 15/02188* (2013.01);
(Continued)

(58) Field of Classification Search
CPC ..... E04F 15/02188; E04F 15/0215; E04F 15/02038; E04F 2201/0115; E04F 2201/0107; E04F 2201/043; A47K 3/40
See application file for complete search history.

(56) References Cited

U.S. PATENT DOCUMENTS 5,299,330 A * 4/1994 Moore ..... A47K 3/405 4/612
5,913,777 A * 6/1999 Gerber ..... A47K 3/40 4/596

(Continued)

FOREIGN PATENT DOCUMENTS

EP 0256189 B1 * 10/1991
GB 2365880 A * 2/2002 ..... E04F 15/0215

(Continued)

OTHER PUBLICATIONS

International Search Report and Written Opinion, PCT/AU2021/050362, Jul. 7, 2021 (11 pages).

*Primary Examiner* — Adriana Figueroa
(74) *Attorney, Agent, or Firm* — Ware, Fressola, Maguire & Barber LLP

(57) ABSTRACT

The present invention relates to a floor panel, a flooring system including the panel and methods of use thereof for forming a graded wet area, floor, pathway or decking. In one form, the present invention provides a floor panel for forming a graded wet area. The panel includes a pair of opposed surfaces including an upper surface and an opposed lower surface interconnected by opposed side edges, a first end edge and an opposed second end edge. The panel further includes a plurality of protrusions protruding from one of the opposed surfaces and extending at least partially across the panel between the opposed side edges, said protrusions protruding at differing heights from the one of the opposed surfaces to define a panel gradient extending between the first end edge and the second end edge.

15 Claims, 6 Drawing Sheets

(52) U.S. Cl.
CPC ... *E04F 15/02038* (2013.01); *E04F 15/02183* (2013.01); *E04F 2201/0115* (2013.01)

(56) References Cited

U.S. PATENT DOCUMENTS

| | | | | |
|---|---|---|---|---|
| 6,101,778 | A * | 8/2000 | M.ang.rtensson | E04F 15/02 52/592.1 |
| 6,247,285 | B1 * | 6/2001 | Moebus | E04F 15/04 52/480 |
| 6,332,733 | B1 * | 12/2001 | Hamberger | C08L 81/06 52/592.4 |
| 6,385,936 | B1 * | 5/2002 | Schneider | E04F 15/02 52/592.1 |
| 6,588,166 | B2 * | 7/2003 | Martensson | E04B 1/6129 52/592.1 |
| 6,647,689 | B2 * | 11/2003 | Pletzer | E04F 15/04 52/592.4 |
| 6,941,703 | B2 * | 9/2005 | MacLean | E04F 19/10 4/612 |
| 7,694,358 | B2 * | 4/2010 | Stimpson | A47K 3/40 4/612 |
| 7,979,927 | B2 * | 7/2011 | Daniels | A47K 3/40 52/302.1 |
| 8,112,831 | B2 * | 2/2012 | Cook | A47K 3/40 4/613 |
| 8,375,480 | B2 * | 2/2013 | Cook | A47K 3/40 4/613 |
| 8,991,055 | B2 * | 3/2015 | Cappelle | E04F 15/045 29/897.3 |
| 9,016,018 | B2 * | 4/2015 | Boyle | E04F 15/182 52/749.11 |
| 10,988,919 | B2 * | 4/2021 | Self | A47K 3/40 |
| 11,293,189 | B2 * | 4/2022 | Meyers | E04F 15/02194 |
| 2010/0000169 | A1 | 1/2010 | Grave et al. | |
| 2015/0068145 | A1 | 3/2015 | Sjoden et al. | |
| 2017/0183864 | A1 * | 6/2017 | Sjödén | E04F 15/02161 |

FOREIGN PATENT DOCUMENTS

| | | | |
|---|---|---|---|
| WO | 20070141605 | A2 | 12/2007 |
| WO | 20180098526 | A1 | 6/2018 |

* cited by examiner

FLOOR PANEL AND METHODS OF USE THEREOF

TECHNICAL FIELD

The present invention relates to a floor panel, a flooring system including the panel and methods of use thereof for forming a graded wet area, floor, pathway or decking.

BACKGROUND

Proper drainage is critical in any construction project, particularly in the building industry. Improper drainage can quickly lead to deterioration of building elements and costly repairs.

For example, modern building and construction codes generally require that any wet area (e.g., bathrooms, laundries, en suites and the like) be constructed so that water flows to a floor waste or drainage inlet defined in the wet area floor, without ponding or pooling of water. This is typically achieved by forming a graded wet area floor that permits drainage to the floor waste.

The forming of graded wet area floors generally involves forming a recessed area known as a "step down" in a slab in the location where the wet area is intended to be located. A graded wet area floor is then manually formed atop the step down with a dry mix of concrete. The wet area is formed to fall or taper towards the floor waste defined in the step down. Once formed, the floor is allowed to dry before being typically finished with water proofing and tiling.

Likewise, outdoor entertainment areas, such as, e.g., decks, patios and the like, and outdoor pathways are also usually constructed to be graded to permit drainage of water away from the areas or pathways, again without ponding or pooling.

As with the forming of graded wet area floors, the process typically includes manually forming the area or pathway to fall or taper away from the area or pathway, generally to a side of the area or pathway farthest away from any building structure.

Problems in general with the above processes are that they are time-consuming, tedious and labour-intensive, particularly the defining of a step down in a slab, the manual forming of the graded area, wet area or pathway and the time spent waiting for the area or pathway to set.

The applicant has addressed one or more of the aforementioned problems by virtue of his flooring system as disclosed in International Patent Application No. PCT/AU2017/051314, which is herein incorporated by reference in its entirety.

However, the applicant has recognised that further refinements of the invention are required in order to improve the performance and functionality of the floor panel.

It will be clearly understood that, if a prior art publication is referred to herein, this reference does not constitute an admission that the publication forms part of the common general knowledge in the art in Australia or in any other country.

SUMMARY OF INVENTION

Embodiments of the present invention provide a floor panel, a flooring system and methods of use thereof, which may at least partially address one or more of the problems or deficiencies mentioned above or which may provide the public with a useful or commercial choice.

According to a first aspect of the present invention, there is provided a floor panel for use or when used for forming a graded wet area, said panel including:

- a pair of opposed surfaces including an upper surface and an opposed lower surface interconnected by opposed side edges, a first end edge and an opposed second end edge; and
- a plurality of protrusions protruding from one of the opposed surfaces and extending at least partially across the panel between the opposed side edges, said protrusions protruding at differing heights from the one of the opposed surfaces to define a panel gradient extending between the first end edge and the second end edge.

According to a second aspect of the present invention, there is provided a floor panel for use or when used for forming a graded floor or pathway, said panel including:

- a pair of opposed surfaces including an upper surface and an opposed lower surface interconnected by opposed side edges, a first end edge and an opposed second end edge; and
- a plurality of protrusions protruding from one of the opposed surfaces and extending at least partially across the panel between the opposed side edges, said protrusions protruding at differing heights from the one of the opposed surfaces to define a panel gradient extending between the first end edge and the second end edge.

According to a third aspect of the present invention, there is provided a floor panel for use or when used for forming graded decking, said panel including:

- a pair of opposed surfaces including an upper surface and an opposed lower surface interconnected by opposed side edges, a first end edge and an opposed second end edge; and
- a plurality of protrusions protruding from one of the opposed surfaces and extending at least partially across the panel between the opposed side edges, said protrusions protruding at differing heights from the one of the opposed surfaces to define a panel gradient extending between the first end edge and the second end edge.

According to a fourth aspect of the present invention, there is provided a wet area flooring system for forming a graded and waterproofed wet area floor in a room, said system including:

- a plurality of floor panels as defined in the first aspect configured to be arranged on a support surface around at least one floor waste in a side edge-to-side edge arrangement so as to form a graded wet area floor in which a gradient of each panel directs water or any other liquid in a direction towards the at least one floor waste; and
- one or more skirting boards configured to be arranged around an outer edge of room at a junction between an adjacent wall and an outer end edge of an adjacent floor panel, each said skirting board having a pair of opposed surfaces, including a wall abutting surface and an outer surface, said opposed surfaces being interconnected by opposed end edges and opposed side edges, each said skirting board extending longitudinally between said opposed end edges, wherein when arranged, said plurality of floor panels and said one or more skirting boards are waterproof bonded to adjacently arranged floor panels and skirting boards.

Advantageously, the floor panel of the present invention enables a graded floor, pathway, wet area or decking to be readily formed by simply laying or fastening one or more of the panels atop a support surface in a side edge-to-side edge arrangement. The floor panels are particularly advantageous in quickly forming graded wet area floors as they obviate the need for a step down to be defined in the slab and the need to manually form a graded floor atop the step down with a dry mix of concrete. Subsequently, a graded wet area floor can be quickly formed with the panels by removing any delay in waterproofing and tiling the intended wet area while waiting for a manually formed graded floor to set, for example. Moreover, being preformed load bearing panels, the panels of the present invention obviate the time required to apply formwork, pour concrete and wait for the concrete to cure. As such, a graded wet area floor can now be quickly formed with the panels by removing any delay in waterproofing and tiling the intended wet area while waiting for a manually formed graded floor to set, for example. Indeed, in some embodiments, the present invention obviates the need to waterproof.

As used herein, the term "floor waste" refers to a drain inlet defined in a floor surface.

As used herein, the term "step down" refers to a recessed area defined in a slab, usually in a location where a wet area is intended to be located. For example, step downs are typically defined in a slab where a bathroom, laundry or en suite is intended to be located.

As used herein, the term "fall" refers to the gradient of a floor surface or part or portion thereof. Typically, the fall is a negative gradient that is directed in a desired location, such as, e.g., towards a floor waste, a drain or a desired edge.

The floor panel may be of any suitable size, shape and construction and may be formed from any suitable material or materials.

Generally, the floor panel may have a polygonal shape suitable for tiling. Typically, the panel may be substantially rectangular, triangular, hexagonal, heptagonal, octagonal or oblong-shaped, or any variation or combination thereof. Preferably, the panel may be substantially rectangular or square-shaped.

As indicated, the floor panel has a pair of opposed surfaces including an upper surface and an opposed lower surface. The opposed surfaces may extend substantially parallel with one another. The opposed surfaces are interconnected by opposing edges, including opposed side edges, a first end edge or inner end edge and an opposed second end edge or outer end edge.

The floor panel may be of any desired length and/or width.

For example, the panel may have a length and/or width of at least 200 mm, at least 250 mm, at least 300 mm, at least 350 mm, at least 400 mm, at least 450 mm, at least 500 mm, at least 550 mm, at least 600 mm, at least 650 mm, at least 700 mm, at least 750 mm, at least 800 mm, at least 850 mm, at least 900 mm, at least 950 mm, at least 1,000 mm, at least 1,050 mm, at least 1,100 mm, at least 1,150 mm, at least 1,200 mm, at least 1,250 mm, at least 1,300 mm, at least 1,350 mm, at least 1,400 mm, at least 1,450 mm, at least 1,500 mm, at least 1,550 mm, at least 1,600 mm, at least 1,650 mm, at least 1,700 mm, at least 1,750 mm, at least 1,800 mm, at least 1,850 mm, at least 1,900 mm, at least 1,950 mm, at least 2,000 mm, at least 2,050 mm, at least 2,100 mm, at least 2,150 mm, at least 2,200 mm, at least 2,250 mm, at least 2,300 mm, at least 2,350 mm, at least 2,400 mm, at least 2,450 mm, at least 2,500 mm, at least 2,550 mm, at least 2,600 mm, at least 2,650 mm, at least 2,700 mm, at least 2,750 mm, at least 2,800 mm, at least 2,850 mm, at least 2,900 mm, at least 2,950 mm, at least 3,000 mm, at least 3,050 mm, at least 3,100 mm, at least 3,150 mm, at least 3,200 mm, at least 3,250 mm, at least 3,250 mm, at least 3,300 mm, at least 3,350 mm, at least 3,400 mm, at least 3,450 mm, at least 3,500 mm, at least 3,550 mm, at least 3,600 mm, at least 3,650 mm, at least 3,700 mm, at least 3,750 mm, at least 3,800 mm, at least 3,850 mm, 3,900 mm, at least 3,950 mm or at least 4,000 mm.

In some embodiments, the floor panel may be provided in one or more standard lengths and/or widths.

For example, the floor panel may be provided in standard lengths of about 300 mm, about 450 mm, about 900 mm, about 1,200 mm, about 1,600 mm, about 1,800 mm, about 2,100 mm, about 2,400 mm, about 2,700 mm, about 3,000 mm or about 4,000 mm.

Likewise, the floor panel may be provided in standard widths of about 300 mm, about 450 mm, about 600 mm, about 900 mm, about 1,200 mm or about 1,350 mm.

In other embodiments, the floor panel may be formed to custom lengths and/or widths. For example, the panel may be provided with a tapered width extending from the outer end edge to the inner end edge so as to enable the panel to be arranged with other like panels around a common floor waste without the panel needing to be trimmed and/or mitred along one or both side edges.

The panel may be of any suitable thickness as measured between the opposed surfaces. For example, the panel may have a thickness of about 1 mm, about 1.5 mm, about 2 mm, about 2.5 mm, about 3 mm, about 3.5 mm, about 4 mm, about 4.5 mm, about 5 mm, about 5.5 mm, about 6 mm, about 6.5 mm, about 7 mm, about 7.5 mm, about 8 mm, about 8.5 mm, about 9 mm, about 10 mm, about 11 mm, about 12 mm, about 13 mm, about 14 mm, about 15 mm, about 16 mm, about 17 mm, about 18 mm, about 19 mm or even about 20 mm or more. Typically, the panel may have a maximum thickness, as measured between the opposed surfaces, of about 2.5 mm.

As indicated, the panel includes a plurality of protrusions protruding from one of the opposed surfaces to define a panel gradient extending between the first end edge and the second end edge. The protrusions may be of any suitable size, shape and form and may be arranged in any suitable arrangement on the surface of the panel, preferably the lower surface.

The protrusions may be of integral construction with the panel or may be separate panel pieces fastened to the panel, preferably the former.

In some embodiments, the plurality of protrusions may include a plurality of nodules protruding from the lower surface. In such embodiments, the nodules may be arranged in discrete locations across the lower surface and may extend to differing heights from the lower surface to define the panel gradient.

The nodules may be arranged in an ordered or random arrangement at least partially across the lower surface of the panel, preferably ordered, more preferably in an array.

The nodules may have any suitable cross-sectional shape. For example, the nodules may have a substantially circular, rectangular, triangular, hexagonal, heptagonal, octagonal or oblong-shaped cross-sectional shape, or any variation or combination thereof. The nodules may have a flat or rounded outer end configured to abut or sit atop a support surface.

In preferred embodiments, the plurality of protrusions may include a plurality of ridges protruding from the lower surface. Each ridge may longitudinally extend at least partially across the lower surface, preferably between the opposed side edges, more preferably in an orientation parallel with the first and/or second end edges.

The plurality of ridges may be arranged across the lower surface in a spaced arrangement, preferably at regular spaced intervals. The ridges may be arranged at any suitable distance from one another to provide a desired load capacity for the panel. For example, the ridges may be arranged at spaced intervals of about 5 mm, about 6 mm, about 7 mm, about 8 mm, about 9 mm, about 10 mm, about 11 mm, about 12 mm, about 13 mm, about 14 mm, about 15 mm, about 16 mm, about 17 mm, about 18 mm, about 19 mm, about 20 mm, about 21 mm, about 22 mm, about 23 mm, about 24 mm, about 25 mm, about 26 mm, about 27 mm, about 28 mm, about 29 mm, or even about 30 mm or more from one another.

Each ridge may have any suitable profile shape and may be of any suitable height, width and/or thickness.

For example, each ridge may include a pair opposed side surfaces interconnected by opposing edges, including a pair of opposed side edges and an outer end edge longitudinally extending along a length of the ridge. In some embodiments, the opposed side surfaces may extend substantially parallel to one another. In other embodiments, the opposed side surfaces may taper or converge towards one another as they extend from the lower surface of the panel to the outer end edge. The outer end edge may be rounded or may be substantially flat for resting atop a support surface.

In preferred embodiments, each ridge may include a pair of opposed side surfaces extending substantially parallel to one another and interconnected by the pair of opposed side edges and the outer end edge.

Generally, each ridge may have a width, as defined as the distance between the opposed side edges, of about the same or partially less than the width of the panel.

Each ridge may be of any suitable height to provide a desired gradient. Typically, the ridges may have a maximum height of about 4 mm, about 4.5 mm, about 5 mm, about 5.5 mm, about 6 mm, about 6.5 mm, about 7 mm, about 7.5 mm, about 8 mm, about 8.5 mm, about 9 mm, about 9.5 mm, about 10 mm, about 10.5 mm, about 11 mm, about 11.5 mm, about 12 mm, about 12.5 mm, about 13 mm, about 13.5 mm, about 14 mm, about 14.5 mm, or about 15 mm or more at or near the second or outer end edge of the panel. Preferably, the ridges may have a maximum height of about 8.5 mm. Conversely, the ridges may have a minimum height of about 0.1 mm, about 0.2 mm, about 0.3 mm, about 0.4 mm, or about 0.5 mm or more at or near the first or inner end edge of the panel.

Typically, each ridge may have a thickness, as defined between the opposed side surfaces, of about 0.8 mm, about 0.9 mm, about 1.0 mm, about 1.1 mm, about 1.2 mm, about 1.3 mm, about 1.4 mm, about 1.5 mm, about 1.6 mm, about 1.7 mm, about 1.8 mm, about 1.9 mm, about 2.0 mm, about 2.1 mm, about 2.2 mm, about 2.3 mm, about 2.4 mm, about 2.5 mm, about 2.6 mm, about 2.7 mm, about 2.8 mm, about 2.9 mm, about 3.0 mm, about 3.1 mm, about 3.2 mm, about 3.3 mm, about 3.4 mm, or even about 3.5 mm or more. Preferably, each ridge may have a thickness of about 1.5 mm.

The plurality of protrusions may range in height from the first or inner end edge to the second or outer end edge to define a suitable panel gradient that permits the drainage of water atop the panel from the second or outer end edge to the first or inner end edge when the panel sits atop a support surface.

For example, in some embodiments, the panel may have a gradient from about 0.005% to about 2.0%, preferably ranging from about 0.009% to about 0.05%, more preferably ranging from about 0.009% to about 0.035%.

The gradient may preferably be a negative gradient extending from the second or outer end edge to the first or inner end edge when the panel sits atop a support surface.

Generally, the panel and the protrusions may be formed from durable and load bearing material or materials. For example, the floor panel may be formed from metal, plastic, rubber, glass, fibre, concrete, stone and/or wood material and/or materials.

In preferred embodiments, the panel and the protrusions may be formed from a plastic material or a plastic composite material. For example, the panel may be formed from polyvinyl chloride ("PVC"). In such embodiments, the panel may be preferably be waterproof. The panel may be formed by injection moulding.

In some such embodiments, the panel may be formed from a heat resistant or thermally stable plastic. Advantageously, by having heat resistant or thermally stable properties, the plastic floor panels may be safely used with an under-tile heating system.

In some embodiments, at least one of the opposed surfaces of the panel may be textured to at least partially assist in fastening material to the panel, such as, e.g., water proofing, tiling, decking or the like. Preferably, both the opposed surfaces may be textured.

In some embodiments, the panel or at least part of the panel may be treated with a damp-proof or waterproofing coating.

In some embodiments, at least one of the opposed surfaces of the panel, preferably the upper surface may include one or more markings to assist in arranging materials atop the panel. For example, in one such embodiment, the upper surface of the floor panel may include markings to assist in the placement of tiling atop the panel. In another such embodiment, the upper surface may include markings to assist in the placement and/or spacing of deck boards atop the panel.

Generally, the panel may be laid atop and/or fastened to a support surface with one or more other like panels to form a graded pathway, floor, wet area or decking area. The panels may be arranged in any suitable way.

The support surface may be any suitable surface atop of which the panel may be laid and/or fastened. Typically, the support surface may be a portion or part of a slab, a step down area defined in slab, two or more horizontal support beams, such as, e.g., floor joists, or one or more other underlying floor panels (e.g., Scion™ or Secura™ interior flooring panels or HardiePanel™ compressed sheet) supported atop one or more horizontal support beams. In embodiments in which the support surface comprises two or more horizontal support beams, a panel or sheet may be laid atop to cover any gaps between the horizontal support beams prior to the panels being laid and/or fastened. The panel or sheet of sheet may comprise a plywood or block board panel or sheet, for example.

Typically, each panel may be laid atop or fastened to the support surface in a side edge-to-side edge arrangement with other like panels to form a graded surface. In some embodiments, the panels may need to be trimmed and/or mitred along one or both side edges to be suitably arranged. The side edges of adjacently positioned panels may or may not be joined together.

Likewise, in some embodiments, a first panel may be joined with an adjacent second panel in an end edge-to-end edge arrangement to form a continuous graded surface.

The panels may be joined together in any suitable way.

For example, in some embodiments, the edges may be joined together by one or more fasteners. The one or more fasteners may include one or more mechanical fasteners (such as, e.g., threaded fasteners) and/or one or more chemical fasteners (such as, e.g., a wet adhesive, a dry adhesive or a double-sided adhesive tape).

In other embodiments, edges of adjacently positioned panels may be connected together by a connecting mechanism or part of a connecting mechanism. For example, a first panel may have a first part of a connecting mechanism associated with a portion of an edge and a second panel may have a second part of the connecting mechanism connectable to the first part of the connecting mechanism and associated with a portion of an edge of the second panel to be joined to the edge of the first panel.

The connecting mechanism may include mateable male and female portions that couple together, including interference fit (snap-fit) connections, for example. The connecting mechanism may include a male formation associated with an edge of a first panel configured to be inserted into or coupled with a female formation associated with an edge of a second panel to be joined to the edge of the first panel.

In some embodiments, the panel may include a connecting mechanism or part of a connecting mechanism on at least one of the opposed side edges and the opposed end edges, preferably the opposed end edges. For example, the connecting mechanism may include a male formation associated with a first end edge of a first panel configured to be at least partially received in a female formation associated with a second end edge of a second panel.

The female formation may include a channel defined at or near the first edge and longitudinally extending at least partially along the edge. The channel may include a first channel sidewall defined by the panel and a second channel sidewall defined by a substantially L-shaped member that extends from the lower surface of the panel at or near the edge to define a channel base wall and the second channel sidewall of the channel. The inner surfaces of the channel sidewalls may narrow at or near the base wall to provide a snug fit for a corresponding male formation.

In some embodiments, at least one of the first channel sidewall and the second channel sidewall may include an inwardly turned edge portion, preferably at least the first channel sidewall.

In some embodiments, at least one of the first channel sidewall and the second channel sidewall may include a tapered edge portion that expands rearwardly from a tapered edge to define an enlarged inwardly extending portion, preferably at least the second channel sidewall.

The male formation may include a pair of edge members extending from and at least partially longitudinally along the second end edge of the second panel, preferably extending from and at least partially along a sidewall of a protrusion located at or near the second end edge.

The pair of edge members may be configured to be frictionally fitted at least partially into the channel of the female formation. In some embodiments, the sidewall of the protrusion may function as a biasing member for biasing the edge members apart from one another to engage with the sidewalls of the channel of the female formation when the male formation is at least partially inserted into the female formation.

In some embodiments, at least one of the edge members may further include a retention portion extending from an outer end configured to be snugly received in and frictionally engage with the channel of the female formation. The retention portion may include a linear portion extending at an angle from the edge member and a curved portion extending from the linear portion and curving back at least partially towards the other edge member.

In some such embodiments, the retention portion may extend from an outwardly turned outer edge of the at least one edge member to define a shaped groove. The shaped groove may be defined by the retention portion, the at least one edge member and a portion of the sidewall of the protrusion. The shaped groove may be configured to at least partially receive the inwardly turned edge portion of a corresponding channel sidewall of the female formation for retaining the male and female formations together when connected.

In some embodiments, the channel of the female formation may further include one or more positioning members for correctly positioning the retention portion of the male formation when received in the female formation. For example, the channel may include a positioning member extending from an inner surface of the first channel sidewall for positioning or biasing the retention portion at least partially towards the second channel sidewall, and preferably for positioning an outer end of the retention portion at least partially against the enlarged inwardly extending portion of the enlarged tapered edge portion of the second channel sidewall. In such embodiments, the tapered edge of the enlarged tapered edge portion may at least partially abut against and press, urge or bias a corresponding edge member towards the other edge member.

In use and in preferred embodiments, the male formation including the pair of edge members and the retention portion may be at least partially inserted into the channel of the female formation until the inwardly turned edge portion of the first channel sidewall snap fits into the shaped groove defined by the retention portion extending from one of the edge members and the outer end of the retention portion abuts against the enlarged inwardly extending portion of the enlarged tapered edge portion of the second channel sidewall.

Advantageously, the snap fitting of the inwardly turned edge portion and the abutment of the end of retention portion may provide tactile and audible feedback to an installer thereby allowing the installer to join the panels quickly without necessarily relying on visual cues.

The connecting mechanism may also enable the edges to be readily joined in an aligned and correctly oriented manner to provide a graded floor.

In some embodiments, a sealing member or sealing agent may be at least partially applied along at least one edge of edges to be joined together.

Any suitable sealing member or agent may be used that may preferably provide a substantially water-tight seal between side edges of adjacently positioned panels.

In some embodiments, the sealing member may be formed from any suitable material or materials, such as, e.g., closed foam, rubber, expanding resin or a like material suitably adapted to form a seal.

In other embodiments, the sealing agent may include a mastic sealant or any other like sealant suitably adapted to form a seal.

In yet other embodiments, the panels may be joined together by waterproof bonding. The waterproof bonding may include any suitable bonding that is able to achieve a water-tight seal or join between side edges of adjacently positioned panels.

For example, in some embodiments, the waterproof bonding may include plastic welding, preferably hot gas welding. For example, a hot air welder may be used to soften both edges to be joined and a plastic filler rod may be used to apply at least one weld bead along the edges to be joined. Advantageously, the use of plastic welding with plastic panels provides an entirely waterproof solution.

The panels may preferably be arranged or orientated on the support surface such that the fall of each panel is directed in a desired direction.

For example, when forming a graded wet area floor having a floor waste, the panels may typically be arranged or orientated on the support surface such that the gradient or taper of each panel directs water or any other liquid towards the floor waste.

For example, when forming a graded pathway, decking area or floor without a floor waste, the panels may typically be arranged or orientated in a same or similar orientation on the support surface in a side edge-to-side arrangement such that the gradient or taper of each panel directs water or any other liquid in a desired direction, usually away from any adjacent structure. For example, when forming a graded deck, each panel may be orientated to direct water away from an adjacent structure.

The panels may be fastened to the support surface by any suitable means. Typically, each panel may be fastened to the support surface by one or more fasteners, such as, e.g., one or more mechanical fasteners and/or one or more chemical fasteners as described above.

Preferably, the panels may be fastened to the support surface with a chemical adhesive, such as, e.g., a cement-based tile adhesive.

In some embodiments, the panel may be trimmed or shaped to fit around an adjacent structure. For example, the second opposed said end edge of a panel may be trimmed or shaped to snugly fit about a floor waste.

As indicated above, the system of the first aspect further includes one or more skirting boards configured to be arranged around an outer edge of a room at a junction between an adjacent wall and a first opposed end edge of a floor panel for forming a waterproofed wet area floor.

The skirting board may be of any suitable size, shape and construction and may be formed from any suitable waterproof material or materials.

Typically, the skirting board may have a polygonal shape, preferably a rectangular shape for being arranged along the junction. Preferably, each skirting board may have an elongate shape.

As indicated, each skirting board has two opposed surfaces extending substantially parallel to one another and interconnected by opposing edges. The two opposed surfaces include a wall abutting surface configured to be attached or fastened to at least a portion of the wall and an opposed outer surface. The opposing edges include opposed end edges and opposed side edges. The skirting board may preferably extend longitudinally between the opposed end edges.

In some embodiments, the outer surface of each skirting board may be configured to have tiling applied thereon.

In some embodiments, at least the outer surface of the board may be textured to at least partially assist in tiling.

In some embodiments, at least the outer surface of the board may include one or more markings to assist in applying tiles thereon. The markings may preferably assist in the placement of the tiles.

Each skirting board may have a maximum thickness (as measured between the opposed surfaces) of about 1 mm, about 2 mm, about 3 mm, about 4 mm, about 5 mm, about 6 mm, about 7 mm, about 8 mm, about 9 mm, or about 10 mm or more.

Each skirting board may typically have a width (as measured between the opposed side edges) of about 20 mm, about 25 mm, about 30 mm, about 35 mm, about 40 mm, about 45 mm, about 50 mm, about 55 mm, about 60 mm, about 65 mm, about 70 mm, about 75 mm, about 80 mm, about 85 mm, about 90 mm, about 95 mm, about 100 mm, about 105 mm, about 110 mm, about 115 mm, about 120 mm, about 125 mm, about 130 mm, about 135 mm, about 140 mm, about 145 mm, or about 150 mm or more.

The skirting board may be formed from a durable and waterproof material. For example, the board may be formed from metal, plastic, rubber, glass, fibre and/or wood material and/or materials. In some embodiments, the skirting board may be formed from a plastic material or a plastic composite material, such as, e.g., polyvinyl chloride ("PVC").

Preferably the skirting boards may be formed as plastic extrusions to any desired length for extending along a junction.

Each skirting board may be fastened to at least a lower portion of the wall adjacent the junction by any suitable means.

For example, in some embodiments, each skirting board may be fastened to the lower portion of the wall by one or more fasteners. The one or more fasteners may include one or more mechanical fasteners (such as, e.g., threaded fasteners) and/or one or more chemical fasteners (such as, e.g., a wet adhesive, a dry adhesive or a double-sided adhesive tape).

In preferred embodiments, the wall abutting surface of each skirting board may be adhesively bonded to the lower portion of the wall.

In some embodiments, the system may further include one or more shower wall panels configured to be arranged at a junction between a wall and a first opposed end edge of at least one floor panel at a location in which a shower is to be located in the wet area floor. A person skilled in the art will appreciate that the one or more shower wall panels may also be arranged at a junction between a wall and a first opposed end edge of at least one floor panel at a location in which a bath is to be located.

Each shower wall panel may be of any suitable size, shape and construction and may be formed from any suitable waterproof material or materials.

Generally, the shower wall panel, like the skirting board, may have a polygonal shape, preferably a rectangular or square shape for being arranged along the junction in a shower space. Typically, shower wall panel may be sized and shaped to at least partially span the width and height of a shower cavity wall, preferably entirely span.

Each shower wall panel may have two opposed surfaces extending substantially parallel to one another and interconnected by opposing edges.

The two opposed surfaces may include a wall abutting surface configured to be attached or fastened to at least a lower portion of the wall and an opposed outer surface.

The opposing edges may include opposed end edges and opposed side edges. In some embodiments, the shower wall pane may extend longitudinally in a substantially vertical direction between the opposed end edges.

In some embodiments, the outer surface of each shower wall panel may be configured to have tiling applied thereon.

In some embodiments, at least the outer surface of the panel may be textured to at least partially assist in tiling.

In some embodiments, at least the outer surface of the panel may include one or more markings to assist in applying tiles thereon. The markings may preferably assist in the placement of the tiles.

Each shower wall panel may have a maximum thickness (as measured between the opposed surfaces) of about 1 mm, about 2 mm, about 3 mm, about 4 mm, about 5 mm, about 6 mm, about 7 mm, about 8 mm, about 9 mm, or about 10 mm or more.

Again, like the skirting board, the shower wall panel may be formed from a durable and waterproof material. For example, the panel may be formed from metal, plastic, rubber, glass, fibre and/or wood material and/or materials. In some embodiments, the panel may be formed from a plastic material or a plastic composite material, such as, e.g., polyvinyl chloride ("PVC").

Preferably the shower wall panel may be formed as a plastic extrusion to a desired length and/or width for extending along a junction and at least a lower portion of the wall. Typically, each shower wall panel may be trimmed and/or mitred along one or more edges to suitably fit.

In some embodiments, two or more shower wall panels may be arranged side-by-side to fit a corner of a shower space. The two or more shower wall panels may preferably be waterproof bonded together as described above, preferably in a side-to-side edge arrangement.

In some embodiments, the shower wall panels may also be waterproof bonded to adjacently positioned or arranged floor panels to advantageously provide a waterproof shower space in the wet area floor.

In other embodiments, the shower wall panels may be waterproof bonded to an adjacently positioned preformed shower tray, again to advantageously provide a waterproof shower space in the wet area floor.

Each shower wall panel may be fastened to at least a lower portion of the wall adjacent the junction by any suitable means.

For example, in some embodiments, each shower wall panel may be fastened to the lower portion of the wall by one or more fasteners. The one or more fasteners may include one or more mechanical fasteners (such as, e.g., threaded fasteners) and/or one or more chemical fasteners (such as, e.g., a wet adhesive, a dry adhesive or a double-sided adhesive tape).

According to a fifth aspect of the present invention, there is provided a method of forming a graded wet area, said method including:

fastening a plurality of floor panels as defined in the first aspect to a support surface such that the gradient of each panel forms a desired fall towards a floor waste defined in the support surface; and applying waterproofing material and tiling atop the plurality of floor panels.

According to a sixth aspect of the present invention, there is provided a method of forming a graded floor or pathway, said method including:

placing one or more floor panels as defined in the second aspect atop a support surface such that the gradient of each panel extends in a desired direction.

According to a seventh aspect of the present invention, there is provided a method of forming graded decking, said method including:

fastening one or more floor panels as defined in the third aspect to a support surface such that the gradient of each panel forms a desired fall; and fastening decking atop the one or more floor panels.

The methods of the fifth, sixth and seventh aspects may include one or more characteristics of the floor panel and flooring system as hereinbefore described.

For example, in some embodiments the fastening of the floor panels to a support surface may include fastening each panel to the support surface with one or more mechanical fasteners or chemical fasteners such that the gradient of each panel extends in desired direction, typically towards the floor waste of the graded wet area or to a desired side of the graded decking.

In other embodiments, the placing may include aligning and laying each floor panel atop the support surface such that the gradient of each panel extends in the desired direction, typically towards a side of the pathway or in a desired direction or towards a floor waste of the graded floor.

The fastening and/or placing may further include aligning each panel relative to one another in a side edge-to-side edge arrangement and/or an end edge-to-end edge arrangement.

In some embodiments, the fastening or placing may further include trimming and/or mitring one or more of the panels along one or both side edges and/or end edges to enable the panels to be suitable arranged.

In some embodiments, the fastening of decking atop the one or more panels may further include locating markings on an upper surface of the one or more panels and aligning each individual deck board relative to the markings prior to fastening the deck board to the upper surface of the one or more panels with mechanical and/or chemical fasteners.

According to an eighth aspect of the present invention, there is provided a method of forming a graded and waterproofed wet area floor in a room, said method including:

arranging a plurality of the floor panel of the first aspect around at least one floor waste in the room in a side edge-to-side edge arrangement so as to form a graded wet area floor in which a gradient of each panel directs water or any other liquid in a direction towards the at least one floor waste;

arranging one or more skirting boards around an outer edge of the room at junction between an adjacent wall and an outer end edge of an adjacent said floor panel; and waterproof bonding said plurality of floor panel and said one or more skirting boards when arranged to form the waterproofed wet area floor in the room.

The method may include one or more characteristics of the floor panel and flooring system as hereinbefore described.

The arranging may include aligning each floor panel relative to one another in a side edge-to-side edge arrangement with each panel orientated such that the gradient or taper of the panel directs water or any other liquid in a desired direction towards the at least one floor waste.

The arranging may also include aligning each skirting board along the junction between an adjacent wall and the first said opposed end edge of an adjacent said floor panel, preferably such that each said skirting board extends longitudinally in a substantially horizontal orientation.

Generally, the arranging may further include fastening the panels and boards to the support surface and wall, respectively. Typically, the panels and boards may be fastened with one or more chemical fasteners, such as, e.g., a wet adhesive, a dry adhesive or a double-sided adhesive tape.

Typically, each panel may be orientated such that the gradient or taper of the panel directs water or any other liquid towards a common side of the graded decking, preferably toward an adjacent drain or away from an adjacent building.

The waterproof bonding may include any suitable bonding in which a waterproof bond is achieved between the panel and/or boards to be bonded. Typically, the bonding may include bonding the plurality of preformed load bearing floor panels and said one or more skirting boards to adjacently arranged floor panels and/or skirting boards, preferably by plastic welding, more preferably by plastic welding applied between adjacent said edges and said side edges to be bonded.

In some embodiments, the method may include, prior to said bonding, arranging one or more shower wall panels at a junction between an adjacent wall and said first said opposed end edge of an adjacent said floor panel at a location in which a shower is to be located.

In such embodiments, the bonding may further include bonding the one or more shower wall panels to adjacently arranged floor panels and/or skirting boards.

Advantageously, in such embodiments, the method may provide a graded and waterproofed wet area with shower space ready for tiling.

Any of the features described herein can be combined in any combination with any one or more of the other features described herein within the scope of the invention.

The reference to any prior art in this specification is not, and should not be taken as an acknowledgement or any form of suggestion that the prior art forms part of the common general knowledge.

BRIEF DESCRIPTION OF DRAWINGS

Preferred features, embodiments and variations of the invention may be discerned from the following Detailed Description which provides sufficient information for those skilled in the art to perform the invention. The Detailed Description is not to be regarded as limiting the scope of the preceding Summary of Invention in any way. The Detailed Description will make reference to a number of drawings as follows.

DETAILED DESCRIPTION

Figure 1:
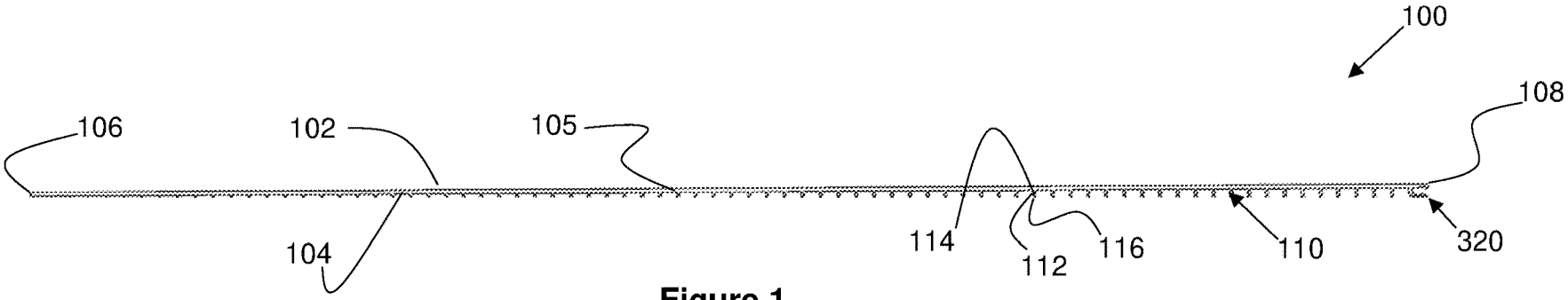
FIG. 1 is a side view of a floor panel according an embodiment of the present invention for defining a graded floor. The floor panel has an inner end edge and an opposed outer end edge.

FIG. 1 shows a floor panel (100) according to an embodiment of the present invention.

The floor panel (100) has an upper surface (102), an opposed lower surface (104), opposed side edges (105), a first or inner end edge (106) and an opposed second or outer end edge (108). The panel (100) further includes a plurality of ridges (110; i.e., protrusions) protruding from and longitudinally extending at least partially across the lower surface (104) between the opposed side edges (105) in an orientation parallel with the end edges (106, 108).

The ridges (110) are arranged across the lower surface (104) in a spaced arrangement, wherein the ridges (110) are spaced from one another at regular intervals between the end edges (106, 108).

The ridges (110) are integrally formed with the panel (100) and protrude from the lower surface (104) at differing heights as they extend across the lower surface (104) between the end edges (106, 108) to define a panel gradient extending between the end edges (106, 108). The gradient is a negative gradient extending from the second or outer end edge (108) to the first or inner end edge (106) to permit the drainage of water towards the first or inner end edge (106) when the panel (100) sits atop a support surface.

The panel (100) has a rectangular or square shape and is formed from a durable, heat resistant and load bearing plastic or plastics material or materials by injection moulding.

The panel (100) is provided in a standard length extending between the opposed end edges (106, 108) of 900 mm. However, and with brief reference to FIGS. 2A and 2B, the length is extendable by a further 450 mm or 300 mm, respectively, by the addition of panel extensions (200).

Referring again to FIG. 1, the panel (100) is provided in standard widths of 600 mm, 900 mm, 1,200 mm, 1,350 mm or 1,500 mm extending between the opposed side edges (105).

The panel has a standard thickness as measured between the opposed surfaces (102, 104) of 2.5 mm and the ridges (110) range in height from about 0.1 mm to about 8.5 mm from the lower surface (104) to define a gradient of between about 0.008% and about 0.01%.

Each ridge (110) includes a pair of opposed side surfaces (112) interconnected by opposing edges, including a pair of opposed side edges (114) and an outer end edge (116) longitudinally extending along a length of the ridge (110). The opposed side surfaces (112) extend substantially parallel to one another and the outer end edge (116) is substantially flat for resting atop a support surface.

Each ridge (110) has a thickness, as measured between the opposed side surfaces (112) of about 1.5 mm.

The upper and lower surfaces (102, 104) of the panel (100) are textured to at least partially assist in fastening material to the upper surface (102) of the panel (100), such as, e.g., water proofing, tiling decking or the like, and for fastening the lower surface (104) of the panel (100) to a support surface.

Figure 2A:
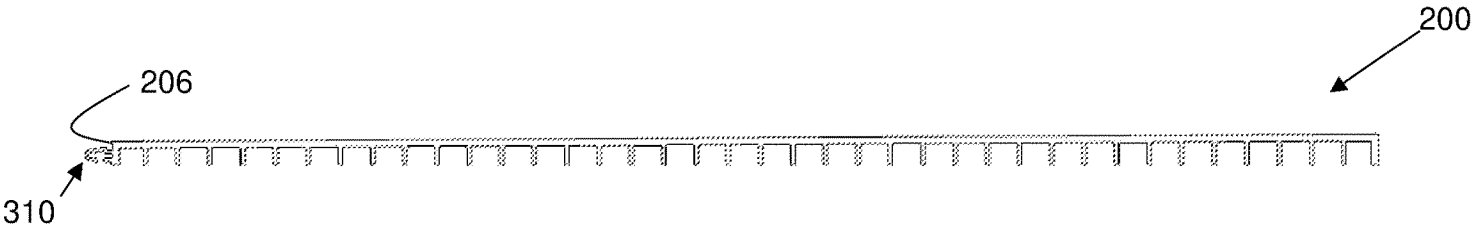
FIGS. 2A and 2B respectively show side views of further floor panels configured to be selectively joined to the outer end edge of the floor panel shown in FIG. 1 in an end edge-to-end edge arrangement to provide an extended graded floor.
Figure 2B:
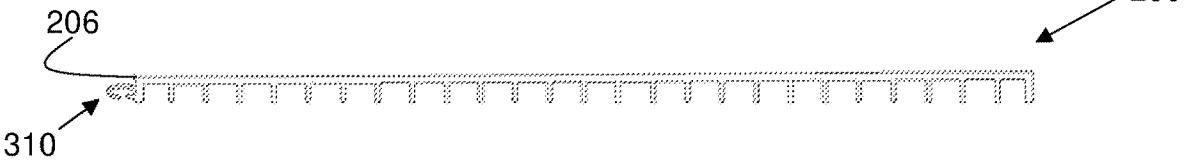

Referring to FIGS. 1, 2A and 2B, the panel (100) is generally intended to be laid atop or fastened to a support surface, such as, e.g., a concrete slab or one or more floor joists, for forming a graded floor, a graded pathway, a graded wet area floor or a graded decking area.

In some embodiments, the panel (100) shown in FIG. 1 may be laid atop or fastened to a support surface in a side edge-to-side edge arrangement to form a graded surface. In such embodiments, the panel (100) may need to be trimmed or mitred along one or both side edges (105) to be suitably arranged and/or joined. If joined together, the side edges (105) are waterproof bonded to one another by plastic welding.

Referring to FIGS. 2A and 2B, in some embodiments, the panel extensions (200) may be joined to the second or outer end edge (108) of the panel (100) shown in FIG. 1 to form a continuous graded surface.

The panel extensions (200) and the panel (100) are joined together by way of a connection mechanism. The connecting mechanism includes mateable male and female formations (310, 320) that are respectively associated with the first or inner end edges (206) of the panel extensions (200) and the second or outer end edge (108) of the panel (100) shown in FIG. 1 and couple together.

Figure 3:
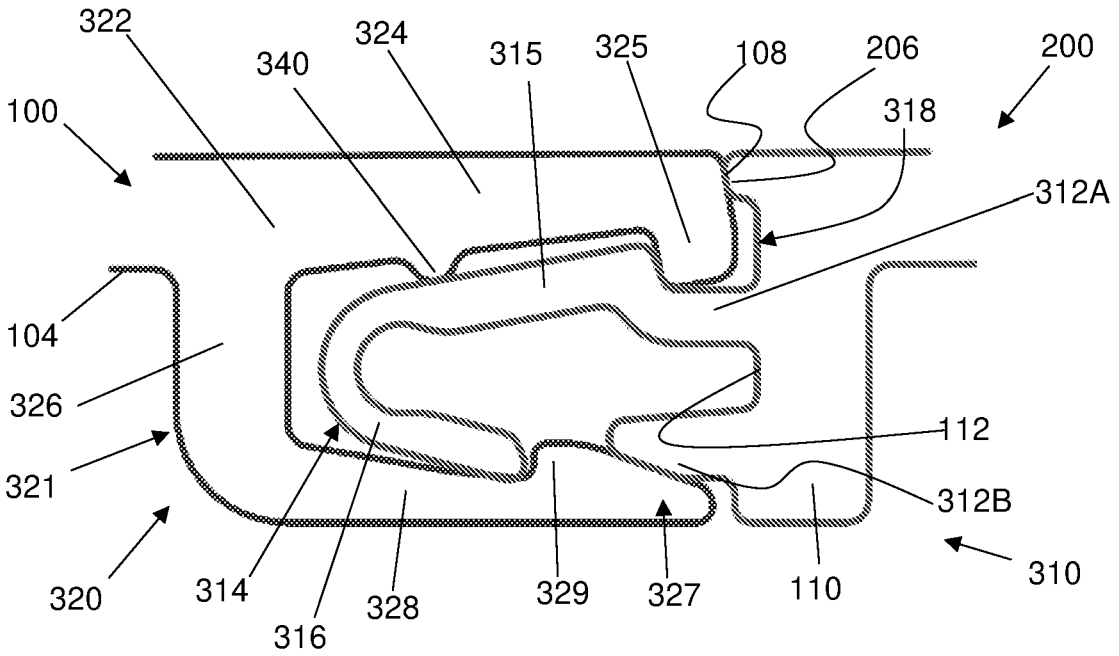
FIG. 3 is a sectional side view of the connecting mechanism for joining the floor panel of FIG. 1 with either further floor panel as shown in FIG. 2A or 2B.

Referring to FIG. 3, the female formation (320) includes a channel (322) defined at and extending longitudinally along the second or outer end edge (108) of the panel (100). The channel (322) includes a first channel sidewall (324) defined by the panel (100) and a substantially L-shaped member (321) that extends from the lower surface (104) of the panel (100) at or near the second or outer end edge (108) to define a channel base wall (326) and a second channel sidewall (328). The inner surfaces of the channel sidewalls (324, 328) narrow at or near the base wall (326) to provide a snug fit for the corresponding male formation (310).

The first channel sidewall (324) includes an inwardly turned edge portion (325) and the second channel sidewall (328) includes a taper edged portion (327) that expands rearwardly from a tapered edge to define an enlarged inwardly extending portion (329).

The male formation (310) includes a pair of edge members (312A, 312B) extending from and at least partially longitudinally along a side surface (112) of an innermost ridge (110) located at or near the first or inner end edge (206) of the panel extension (200). The pair of edge members (312A, 312B) are configured to frictionally fit at least partially into the channel (322) of the female formation (320). The side surface (112) of the ridge (110) functions as a biasing member for biasing the edge members (312A, 312B) apart from one another to engage with the sidewalls (324, 328) of the channel (322) of the female formation (320) when the male formation (310) is at least partially inserted into the female formation (320).

Edge member (312A) further include a retention portion (314) extending from an outer end that is configured to be snugly received in and frictionally engage with the channel (322) of the female formation (320). The retention portion (314) includes a linear portion (315) extending at an angle from the edge member (312A) and a curved portion (316) extending from the linear portion (315) and curving back at least partially towards the other edge member (312B).

The retention portion (314) extends from an outwardly turned outer edge of the edge member (312A) to define a shaped groove (318). The shaped groove (318) being defined by the retention portion (314), the edge member (312A) and a portion of the side surface (112) of the ridge (110). The shaped groove (318) is configured to at least partially receive the inwardly turned edge portion (325) of the first channel sidewall (324) of the female formation (320) for retaining the male and female formations (310, 320) together when connected.

The channel (322) of the female formation (320) further includes a positioning member (340) for correctly positioning the retention portion (314) of the male formation (310) when received in the female formation (320). The positioning member (340) extend from an inner surface of the first channel sidewall (324) for positioning or biasing the retention portion (314) at least partially towards the second channel sidewall (328) and for positioning an outer end of the retention portion (314) at least partially against the enlarged inwardly extending portion (329) of the tapered edge portion (327) of the second channel sidewall (328). In such embodiments, the tapered edge portion (327) at least partially abuts against and presses, urges or biases edge member (312B) towards opposed edge member (312A).

In use, the male formation (310) including the pair of edge members (312A, 312B) and the retention portion (314) are at least partially inserted into the channel (322) of the female formation (320) until the inwardly turned edge portion (325) of the first channel sidewall (324) snap fits into the shaped groove (318) defined by the retention portion (314) extending from edge member (312A) and the outer end of the retention portion (314) abuts against the enlarged inwardly extending portion (329) of the tapered edge portion (327) of the second channel sidewall (328).

Advantageously, the snap fitting of the inwardly turned edge portion (325) and the abutment of the end of retention portion (314) provides tactile and audible feedback to an installer thereby allowing the installer to join the panels and panel extensions (100, 200) quickly without necessarily relying on visual cues.

The connecting mechanism also enable the edges (108, 206) to be readily joined in an aligned and correctly oriented manner to form a continuous graded floor.

Figure 4:
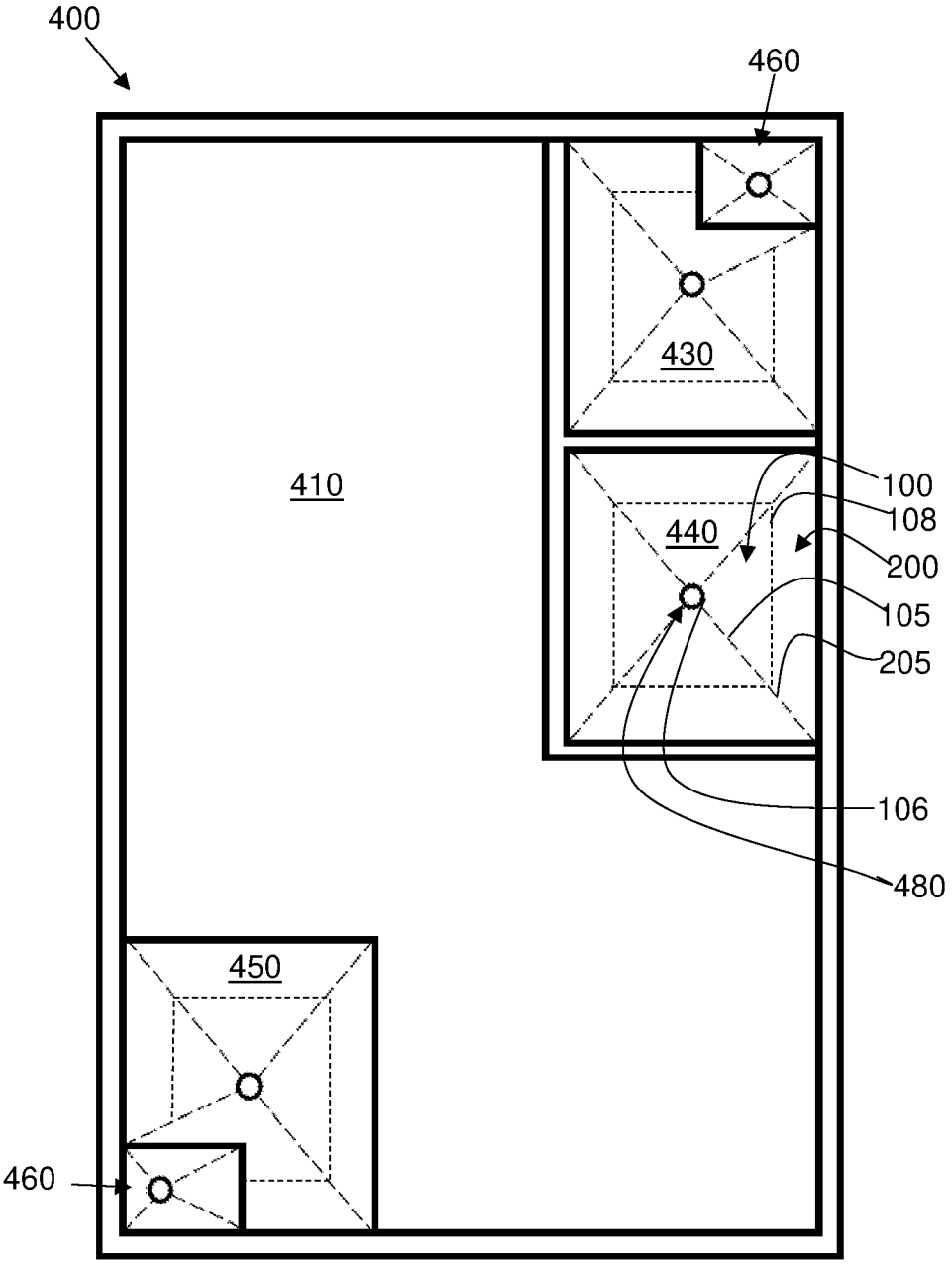
FIG. 4 is a building floor plan showing wet areas in a typical residential dwelling in which a plurality of the floor panels as shown in FIGS. 1, 2A and 2C are installed to form graded wet area floors.

FIG. 4 shows the panel (100) and panel extensions (200) of the present invention being used to form graded wet area surfaces (420) atop a slab (410) in a building (400).

As shown, a plurality of the panel (100) and panel extension (200) are used to form each wet area surface (420) in the bathroom (430), laundry (440), en-suite (450) and in the showers (460) located in the bathroom (430) and en-suite (450).

To form each wet area surface (420), the panels (100) are fastened atop slab (410) in a side edge-to-side edge (105) arrangement about the floor waste (480) defined in each wet surface area (420) and corresponding panel extensions (200) are fastened and connected to the second or outer end edge (108) where needed. Each panel (100) and panel extension (200) is oriented and arranged such that the gradient is able to direct water or any other liquid towards the floor waste (480) for drainage.

The side edges (105, 205) of the panels (100) and panel extensions (200) are mitred to allow them to be suitably arranged in each wet area surface (420). Likewise, the first or inner end edge (106) of each panel (100) is trimmed and/or shaped to snugly fit about the floor waste (480).

Each panel (100) and panel extension (200) is fastened to the slab (410) with a chemical adhesive, such as, e.g., a cement-based tile adhesive.

Figure 5:
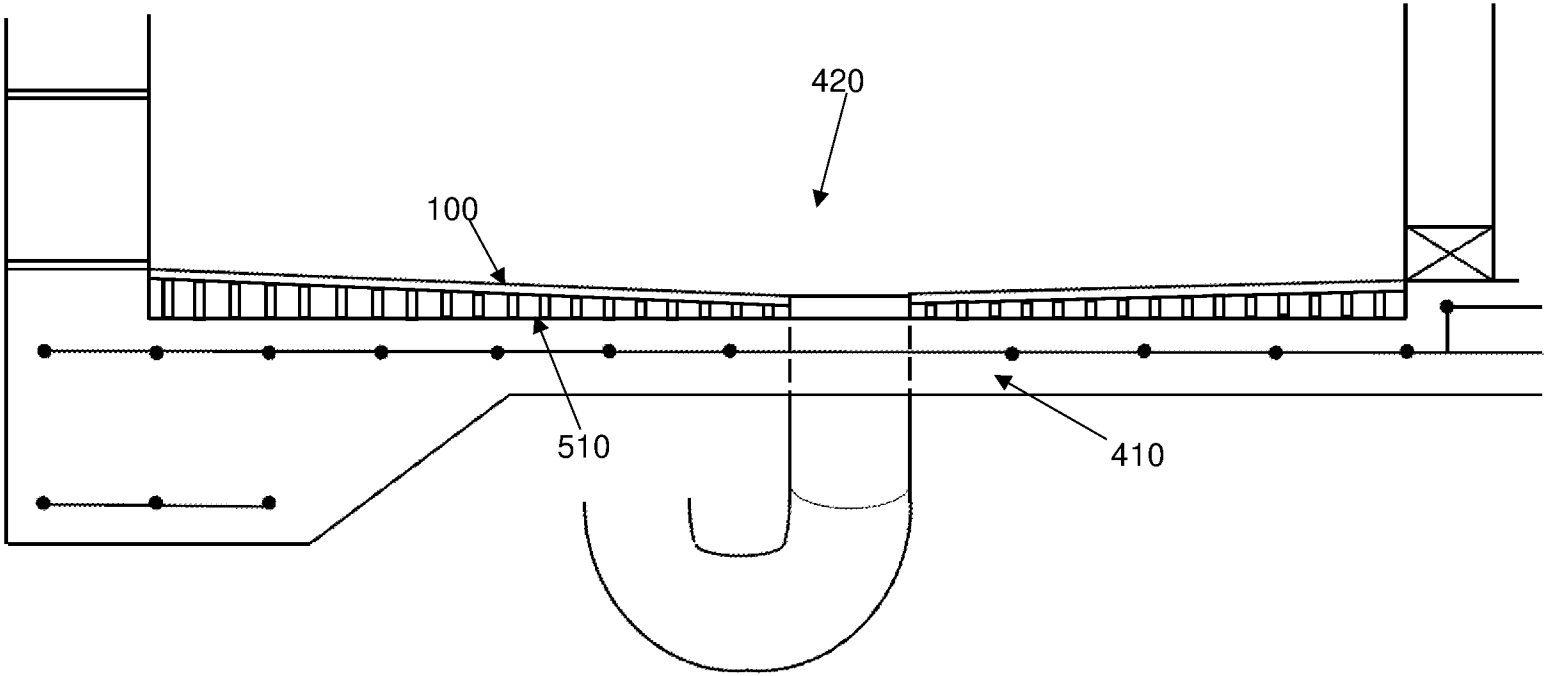
FIG. 5 is a sectional side view showing a plurality of the floor panel shown in FIG. 1 located atop a step down defined in a slab for forming a graded wet area floor.

FIG. 5 shows sectional side views of a plurality of the panel (100) being respectively fastened atop a slab (410) for forming a graded wet area surface (420). The panels (100) are fastened atop a step down (510) defined in the slab (410) where the wet area is intended to be located.

Figure 6:
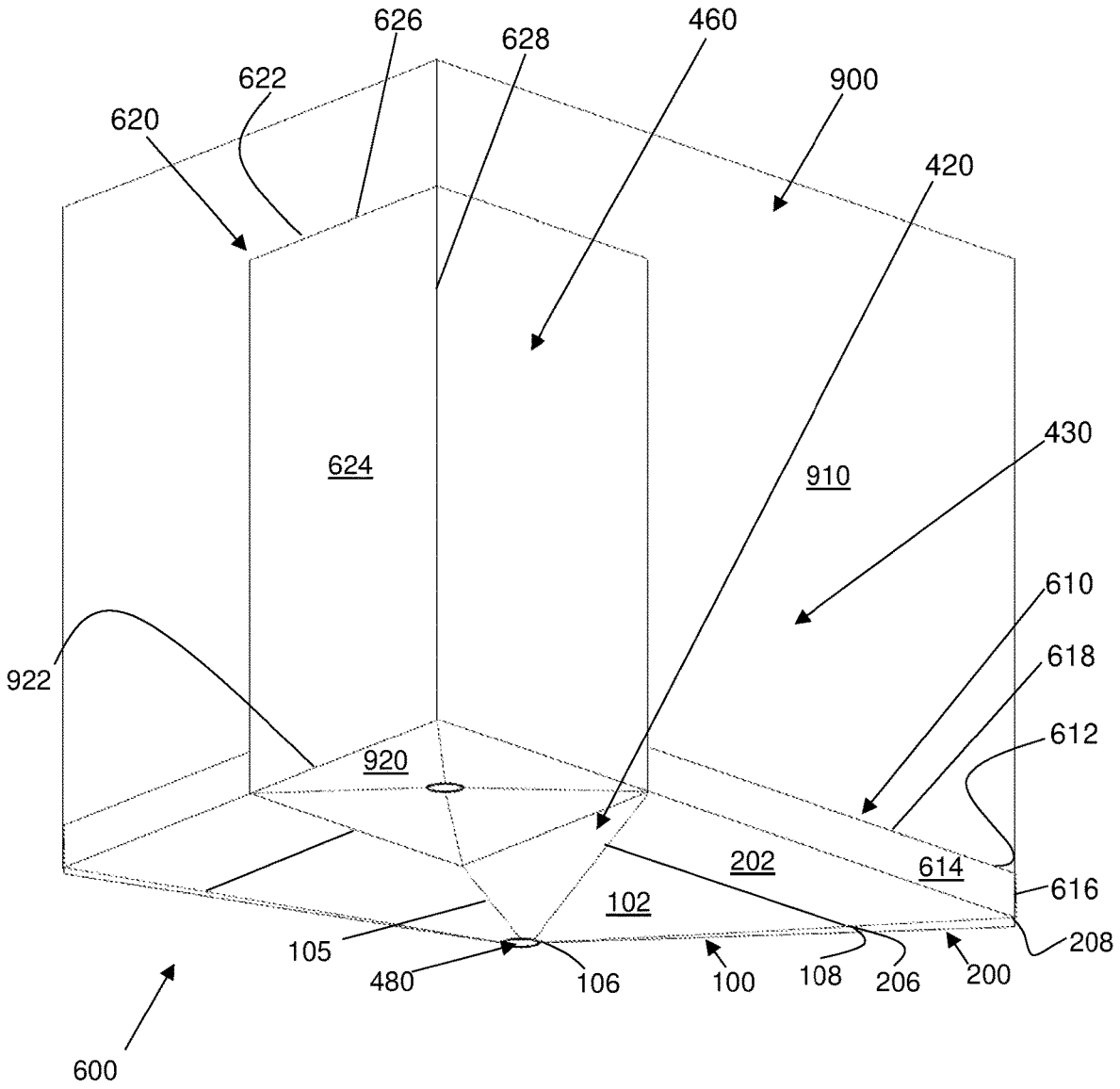
FIG. 6 is a sectional upper perspective view of a wet area fitted with a wet area flooring system according to an embodiment of the present invention to form a graded and waterproofed wet area floor.

FIG. 6 shows a wet area flooring system (600) according to an embodiment of the present invention for forming a graded and waterproof wet area surface (420) floor in a room (900).

The system (600) includes a plurality of floor panels (100) configured to be arranged on a support surface around a floor waste (480) in a side edge (105) to side edge (105) arrangement and a plurality of panel extensions (200) configured to be arranged in an end edge (108) to end edge (206) arrangement with panels (100) as needed so as to form a graded wet area surface (420) in the bathroom (430) of the room (900). A preformed shower tray (920) having a gradient to an associated floor waste (480) is arranged in the shower (460).

The gradient of each floor panel (100), panel extension (200) and shower tray (920) directs water or any other liquid in a direction towards an associated floor waste (480).

The system (600) includes one or more skirting boards (610) configured to be arranged at least partway around an outer edge of the room (900) at a junction between an adjacent wall (910) and the second or outer end edges (108, 208) of adjacently arranged floor panels (100) or panel extensions (200).

Each skirting board (610) includes a wall abutting surface (612), an opposed outer surface (614), opposed end edges (616) and opposed longitudinal side edges (618).

The system (600) further includes one or more shower wall panels (620) configured to be arranged at the junction between an adjacent wall (910) and a side edge (922) of the shower tray (920) at a location in which a shower (460) is to be located in the room (900).

Like with the skirting boards (610), each shower wall panel (620) is of a rectangular shape and includes a wall abutting surface (622), an opposed outer surface (624), opposed end edges (626) and opposed longitudinal side edges (628).

The floor panels (100), the panel extensions (200), the skirting boards (610), the shower wall panels (620) and the shower tray (920) are waterproof bonded to one another by plastic welding to form the waterproofed wet area surface (420) in the room (900).

Each of the upper surfaces (102, 202) of the floor panels (100), panel extension (200), and the outer surfaces (614, 624) of the skirting boards (610) and the shower wall panels (620) are configured to have tiling applied thereon.

Figure 7A:
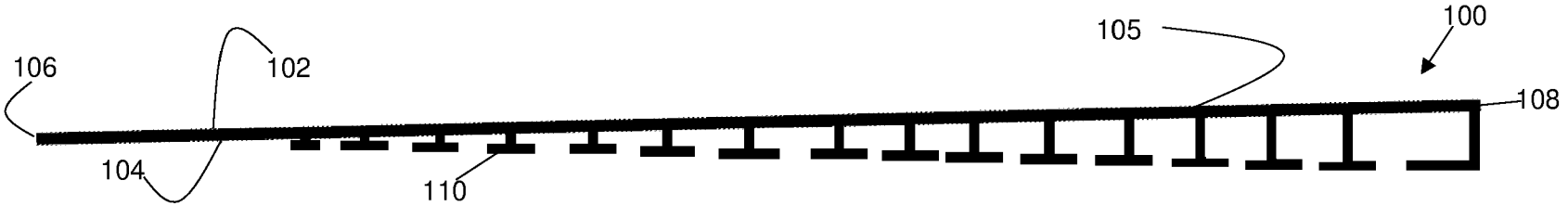
FIGS. 7A to 7C respectively show side views of floor panels according to other embodiments of the present invention.
Figure 7B:
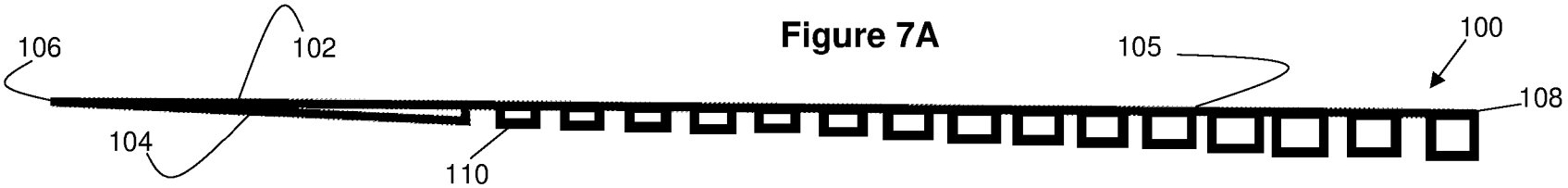
Figure 7C:
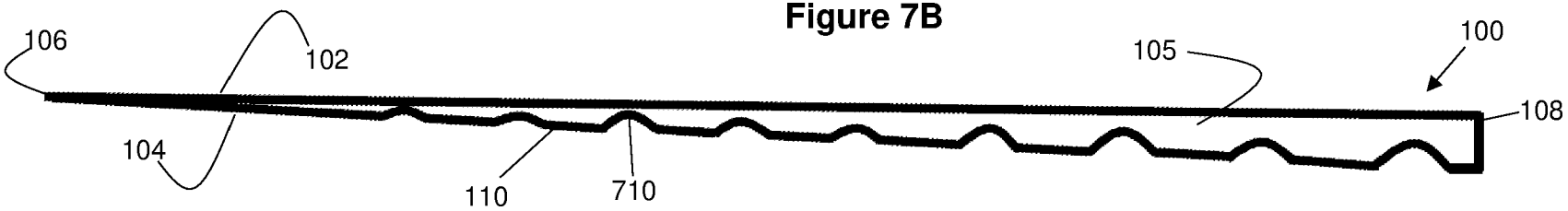

FIGS. 7A to 7C respectively show other embodiments of the floor panel (100). For convenience, features that are similar or correspond to features of the embodiment shown in FIG. 1 will be referenced with the same reference numeral.

Referring to FIG. 7A, the floor panel (100) has an upper surface (102), an opposed lower surface (104), opposed side edges (105), a first or inner end edge (106) and an opposed second or outer end edge (108). The panel (100) further includes a plurality of inverted T-shaped protrusions (110; i.e., protrusions) protruding from and longitudinally extending at least partially across the lower surface (104) between the opposed side edges (105) in an orientation parallel with the end edges (106, 108).

The protrusions (110) are arranged across the lower surface (104) in a spaced arrangement, wherein the protrusions (110) are spaced from one another at regular intervals between the end edges (106, 108).

The protrusions (110) are integrally formed with the panel (100) and protrude from the lower surface (104) at differing heights as they extend across the lower surface (104) between the end edges (106, 108) to define a panel gradient extending between the end edges (106, 108). The gradient is a negative gradient extending from the second or outer end edge (108) to the first or inner end edge (106) to permit the drainage of water towards the first or inner end edge (106) when the panel (100) sits atop a support surface.

Referring to FIG. 7B, the panel (100) in this embodiment includes a plurality of broad ridge protrusions (110; i.e., protrusions) protruding from and longitudinally extending at least partially across the lower surface (104) between the opposed side edges (105) in an orientation parallel with the end edges (106, 108).

Again, the protrusions (110) are arranged across the lower surface (104) in a spaced arrangement, wherein the protrusions (110) are spaced from one another at regular intervals between the end edges (106, 108).

Further, the protrusions (110) are integrally formed with the panel (100) and protrude from the lower surface (104) at differing heights as they extend across the lower surface (104) between the end edges (106, 108) to define a panel gradient extending between the end edges (106, 108). The gradient is a negative gradient extending from the second or outer end edge (108) to the first or inner end edge (106) to permit the drainage of water towards the first or inner end edge (106) when the panel (100) sits atop a support surface.

Referring to FIG. 7C, the panel (100) in this embodiment includes a plurality of depressions (710) formed in the lower surface (104) of the panel (100) and thereby forming a plurality of protrusions (110) extending therebetween. The resulting protrusions (110) again protrude from and extend longitudinally at least partially across the lower surface (104) between the opposed side edges (105) in an orientation parallel with the end edges (106, 108).

The resulting protrusions (110) again protrude from the lower surface (104) at differing heights as they extend across the lower surface (104) between the end edges (106, 108) to define a panel gradient extending between the end edges (106, 108). The gradient is a negative gradient extending from the second or outer end edge (108) to the first or inner end edge (106) to permit the drainage of water towards the first or inner end edge (106) when the panel (100) sits atop a support surface.

In the present specification and claims (if any), the word 'comprising' and its derivatives including 'comprises' and 'comprise' include each of the stated integers but does not exclude the inclusion of one or more further integers.

Reference throughout this specification to 'one embodiment' or 'an embodiment' means that a particular feature, structure, or characteristic described in connection with the embodiment is included in at least one embodiment of the present invention. Thus, the appearance of the phrases 'in one embodiment' or 'in an embodiment' in various places throughout this specification are not necessarily all referring to the same embodiment. Furthermore, the particular features, structures, or characteristics may be combined in any suitable manner in one or more combinations.

In compliance with the statute, the invention has been described in language more or less specific to structural or methodical features. It is to be understood that the invention is not limited to specific features shown or described since the means herein described comprises preferred forms of putting the invention into effect. The invention is, therefore, claimed in any of its forms or modifications within the proper scope of the appended claims (if any) appropriately interpreted by those skilled in the art.

What is claimed:

1. A floor panel for forming a graded wet area for tiling, said panel comprising:

a pair of opposed surfaces comprising an upper surface and an opposed lower surface interconnected by opposed side edges, a first end edge and an opposed second end edge;

a plurality of protrusions protruding from the lower surface and extending at least partially across the floor panel between the opposed side edges, said protrusions protruding at differing heights from the one of the opposed surfaces to define a panel gradient extending between the first end edge and the second end edge; and a part of a connecting mechanism extending along each of the first and second end edges for connecting the floor panel with further floor panels in an end edge to end edge connection, wherein the connecting mechanism comprises a male formation defined on the first end edge of the floor panel and a female formation defined on the second end edge of the floor panel and wherein the male and female formations are configured to mate or couple with corresponding female and male formations provided on at least one of the further floor panels, wherein the female formation comprises a channel extending longitudinally along the first end edge of the floor panel, the channel comprises a first channel sidewall defined by the first end edge of the floor panel, an opposed second channel sidewall and a channel base wall extending therebetween, said second channel sidewall and said channel base wall defined by a substantially L-shaped member extending from the lower surface of the floor panel at or near the first end edge, wherein the male formation comprises a pair of edge members extending from and at least partially along the second end edge of the floor panel and wherein the pair of edge members are configured to be at least partially frictionally fitted into the channel of the female formation of the at least one of the further floor panels, and wherein at least one of the pair of edge members of the male formation comprise a retention portion extending from an outer end and configured to be snugly received in and frictionally engage with the channel to retain the male formation and the female formation of the connecting mechanism together when connected.

2. The floor panel of claim 1, wherein the plurality of protrusions comprise a plurality of nodules arranged in discrete locations across the lower surface and extending to differing heights from the lower surface to define the panel gradient.

3. The floor panel of claim 1, wherein the plurality of protrusions protrude from and longitudinally extend at least partially across the lower surface of the panel at least partially between the opposed side edges in an orientation parallel with the first and second end edges.

4. The floor panel of claim 3, wherein the plurality of protrusions comprises a plurality of inverted T-shaped protrusions.

5. The floor panel of claim 3, wherein the plurality of protrusions are formed by a plurality of depressions formed in the lower surface thereby forming the plurality of protrusions extending therebetween.

6. The floor panel of claim 3, wherein the plurality of protrusions comprise a plurality of ridges protruding from the lower surface.

7. The floor panel of claim 1, wherein the plurality of protrusions are integrally formed with the floor panel.

8. The floor panel of claim 1, wherein the plurality of protrusions define a negative said panel gradient ranging from about 0.005% to about 2.0%.

9. The floor panel of claim 1, wherein the retention portion extends from an outwardly turned outer edge of the at least one of the pair of edge members to define a shaped groove and wherein the shaped groove is configured to at least partially receive an inwardly turned edge portion of a corresponding said first channel sidewall of the female formation for retaining the male and female formations together when connected.

10. The floor panel of claim 1, wherein the connecting mechanism is a snap fitting mechanism enabling adjacent end edges of the floor panel and the at least one of the further floor panels to be readily joined in an aligned and correctly orientated manner to provide the graded wet area.

11. A method of forming a graded wet area, said method comprising:

fastening a plurality of floor panels as defined in claim 1 to a support surface such that a gradient of each floor panel forms a desired fall towards a floor waste defined in the support surface; and applying tiling atop the plurality of floor panels.

12. The method of claim 11, wherein the fastening comprises fastening each floor panel to the support surface with one or more mechanical fasteners and/or chemical fasteners.

13. The method of claim 11, wherein the fastening further comprises one or more of trimming and mitring one or more of the floor panels along one or more of said side edge and an end edge to enable the floor panels to be arranged.

14. The method of claim 11, wherein the applying comprises applying a sealing member or agent between edges of adjacently positioned said floor panels.

15. The floor panel of claim 1, wherein the upper surface of the floor panel is configured to have tiling applied thereon.

* * * * *